US011474464B2

(12) United States Patent
Tanaka et al.

(10) Patent No.: US 11,474,464 B2
(45) Date of Patent: Oct. 18, 2022

(54) FIXING DEVICE AND IMAGE FORMING APPARATUS, WITH SHUT OFF OF DRIVE TRANSMISSION WITH OPENING OPERATION OF COVER

(71) Applicant: CANON KABUSHIKI KAISHA, Tokyo (JP)

(72) Inventors: Makoto Tanaka, Kashiwa (JP); Shutaro Saito, Tokyo (JP); Takuya Hasegawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/750,131

(22) Filed: Jan. 23, 2020

(65) Prior Publication Data

US 2020/0159154 A1 May 21, 2020

Related U.S. Application Data

(63) Continuation of application No. PCT/JP2018/028360, filed on Jul. 24, 2018.

(30) Foreign Application Priority Data

Jul. 24, 2017 (JP) ..... JP2017-142613

(51) Int. Cl.
*G03G 15/20* (2006.01)

(52) U.S. Cl.
CPC ..... *G03G 15/2064* (2013.01)

(58) Field of Classification Search
USPC ..... 399/331
See application file for complete search history.

(56) References Cited

U.S. PATENT DOCUMENTS

| | | | | |
|---|---|---|---|---|
| 8,779,335 | B2 | 7/2014 | Saito | |
| 9,020,410 | B2 | 4/2015 | Hasegawa | |
| 9,104,148 | B2 | 8/2015 | Hasegawa | |
| 9,195,180 | B2 | 11/2015 | Hasegawa | |
| 9,195,192 | B2 | 11/2015 | Hasegawa | |
| 9,541,869 | B2 | 1/2017 | Hasegawa | |
| 10,520,862 | B2 | 12/2019 | Hasegawa et al. | |
| 2009/0245826 | A1* | 10/2009 | Dan | G03G 21/206 399/44 |
| 2014/0153938 | A1 | 6/2014 | Saito | |

(Continued)

FOREIGN PATENT DOCUMENTS

| | | | |
|---|---|---|---|
| JP | 04156560 | A * | 5/1992 |
| JP | 09212030 | A * | 8/1997 |

(Continued)

OTHER PUBLICATIONS

International Search Report issued in International Application No. PCT/JP2018/028360 dated Aug. 21, 2018.

(Continued)

*Primary Examiner* — Quana Grainger
(74) *Attorney, Agent, or Firm* — Venable LLP

(57) ABSTRACT

A mechanism for shutting off drive so that drive of pressing release is not rotated even when a pressing roller is rotated as a driving source is provided, and a torque when drive of a shutting-off portion is connected is set at a torque value to which a one-way idling torque is added. Therefore, during jam clearance, connection of pressing release drive by pressing roller rotation can be carried out.

13 Claims, 12 Drawing Sheets

(56) References Cited

U.S. PATENT DOCUMENTS

| | | | | |
|---|---|---|---|---|
| 2015/0003871 | A1 | 1/2015 | Takahashi | |
| 2015/0212456 | A1 | 7/2015 | Imaizumi | |
| 2016/0299462 | A1 | 10/2016 | Buchanan et al. | |
| 2018/0210382 | A1* | 7/2018 | Ishii | G03G 21/1685 |

FOREIGN PATENT DOCUMENTS

| | | | |
|---|---|---|---|
| JP | 2015-11176 | A | 1/2015 |
| JP | 2015-64511 | A | 4/2015 |
| JP | 2015-163953 | A | 9/2015 |

OTHER PUBLICATIONS

Office Action dated Jun. 22, 2021 in counterpart Japanese Application No. 2017-142613, together with English translation thereof.
Office Action dated Oct. 20, 2021 in counterpart Chinese Application No. 201880048807.9, together with English translation thereof.
Office Action dated May 11, 2022 in counterpart Chinese Application No. 201880048807.9, together with English translation thereof.

* cited by examiner

THE OTHER SIDE
(DRIVING SIDE)

FIXING DEVICE AND IMAGE FORMING APPARATUS, WITH SHUT OFF OF DRIVE TRANSMISSION WITH OPENING OPERATION OF COVER

Cross-Reference to Related Applications

This application is a Continuation of International Patent Application No. PCT/JP2018/028360 filed Jul. 24, 2018, which claims the benefit of Japanese Patent Application No. 2017-142613 filed Jul. 24, 2017. The foregoing applications are incorporated herein by reference in their entireties.

TECHNICAL FIELD

The present invention relates to a fixing device for fixing a toner image on a recording material, and relates to an image forming apparatus, including such a fixing device, such as a copying machine, a printer, a facsimile machine or a multi-function machine having a plurality of functions of these machines.

BACKGROUND ART

In recent years, with downsizing of the fixing device and the image forming apparatus, more than a conventional constitution, a driving portion for driving respective modules is also required to be downsized, and further, driving such that a plurality of operations can be performed from the same driving source is required.

For example, a constitution in which a pendulum gear which swings like a pendulum depending on a rotational direction of a driving gear in engagement with the driving gear as a rotatable driving member driven by a driving source capable of being rotated normally and reversely is provided has been known (Japanese Laid-Open Patent Application 2015-64511). In the case of this constitution, by swing of the pendulum gear, a path of transmission of driving from a motor to either of a plurality of gear trains (drive paths) is switched.

Problem to be Solved by the Invention

In the case where a conventional constitution, for switching the drive path, such as the pendulum gear or a one-way clutch is applied to fixing drive and fixing pressing release drive of the fixing device, the following phenomenon occurs in some instances. That is, when jam (JAM) clearance of a fixing portion is performed in a state in which a pressing releasing operation of the fixing pressing release drive is completed, during the jam clearance, a pressing roller is rotated in some instances due to friction between a sheet (recording material) and the pressing roller for fixing drive.

When the pressing roller is rotated by pulling out a jammed paper in a pulling-out direction, of the jammed paper at that time, which is an opposite direction to a normal sheet feeding direction, drive of reverse rotation to normal rotation is transmitted from a fixing drive side toward the driving source (motor). At that time, in a fixing driving portion, the reverse rotation is made and the driving source is not the motor but is the pressing roller, and therefore, a direction of a tangential force generating in a swingable pendulum gear is the same as that during normal fixing drive. Therefore, the swingable pendulum gear in the image form driving portion engages with no drive disconnection.

Then, the reverse rotation of the pressing roller leads to the pressing release drive. At that time, when the pressing release drive is rotated, the position is changed from a pressing release position to a pressing position, and the fixing portion is pressed during the jam clearance, so that situations such that a drawing force of several tens of N or more is needed to clear the jammed paper or that the jammed paper is broken during the clearance thereof can occur.

Here, it would be considered that during the jam clearance, a fixing pressing release amount is made large so that the pressing roller does not rotate. However, in that case, there is a liability that the fixing device is broken by the influence of vibration or the like when in a pressing released state, the fixing device or the image forming apparatus in which the fixing device is mounted is transported, and therefore, a pressing force to the extent that the fixing device is vibrated and broken even when the pressing is released is retained.

The present invention has been proposed in view of the above circumstances. That is, an object (of the present invention) is to realize a constitution, in which the fixing drive and the pressing release drive is switched to each other by normal and reverse rotations of the motor, such that even when the pressing roller is reversely rotated during the jam clearance and the drive is transmitted, the drive is not transmitted to the pressing release drive and the pressing release drive is not rotated unnecessarily.

Means for Solving the Problem

According to an aspect of the present invention, there is provided an image forming apparatus comprising: a pair of rotatable members for fixing a toner image by nipping and feeding a recording material, on which the toner image is carried, in a nip therebetween; a pressing mechanism for press-contacting the pair of rotatable members to each other; a pressing releasing mechanism for releasing press-contact of the pair of rotatable members by the pressing mechanism; and a drive transmission mechanism for switching between a driving force of a driving source which is normally and reversely rotatable in a first direction and a driving force of the driving force in a second direction which is an opposite direction to the first direction to driving of the rotatable members or the pressing releasing mechanism, by a gear with a one-way structure, wherein the drive transmission mechanism is provided with a drive shut off mechanism for shutting off drive so as to prevent the pressing releasing mechanism from operating even when the drive transmission mechanism receives the drive from the rotatable member.

EMBODIMENTS FOR CARRYING OUT THE INVENTION

In the following, preferred embodiments of carrying out the present invention will be described exemplarily and specifically with reference to the drawings. However, dimensions, materials, shapes and relative arrangement of constituent elements described in the embodiments should be appropriately changed depending on structures and various conditions of devices (apparatuses) to which the present invention is applied, and the scope of the present invention is not intended to be limited to the following Embodiments.

Embodiment 1

(1) Image Forming Apparatus

Figure 2:
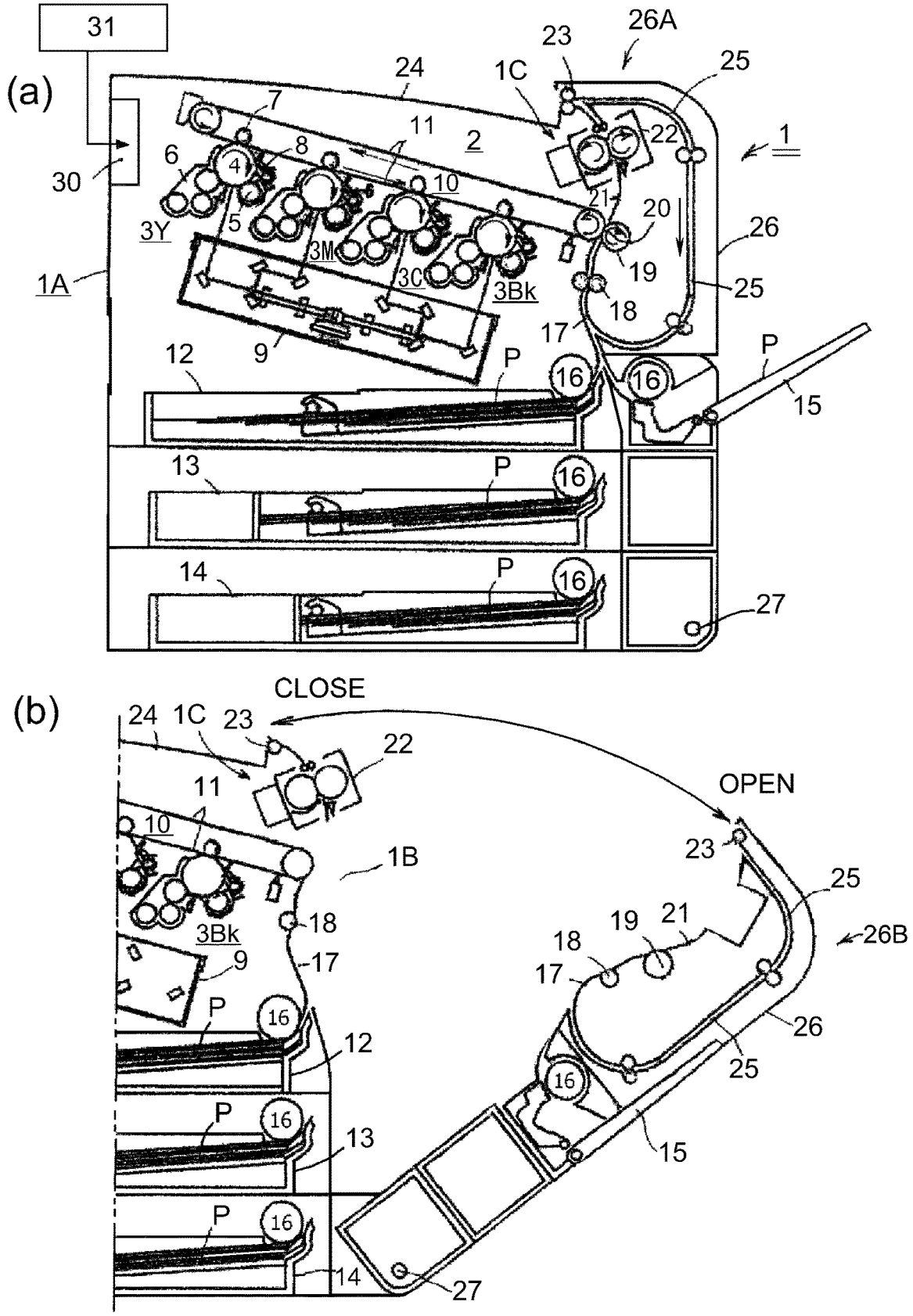
FIG. 2 includes schematic structural views of an example of an image forming apparatus similarly in the Embodiment 1.

Part (a) of FIG. 2 is a schematic sectional view of an example of an image forming apparatus 1 in an embodiment. This image forming apparatus 1 is a four-color-based full-color printer of a tandem type and an intermediary transfer type, using an electrophotographic process (in the following, referred to as a printer). This printer 1 performs an image forming operation on the basis of image information (image signal) inputted from an external terminal 31 such as a personal computer to a controller 30, and is capable of forming a toner image on a recording material (sheet: in the following referred to as a sheet or paper) P and printing out the toner image.

In the printer 1, an image forming portion 2 for forming toner images on the sheets P includes four image forming units (cartridges) 3 (Y, M, C and Bk) for forming the toner images of Y (yellow), M (magenta), C (cyan) and Bk (black), respectively.

Each of the image forming units 3 includes an electrophotographic photosensitive drum 4 to be rotationally driven, and electrophotographic process devices actable on the drum 4, such as a charging roller 5, a developing unit 6, a primary charging roller 7, a drum cleaner 8, and the like.

Incidentally, in order to avoid complicatedness of the figure, reference numerals for representing the devices of the image forming units 3M, 3C and 3K other than the image forming unit 3Y are omitted from illustration in the figure.

Further, the image forming portion 2 includes a laser scanner 9 as an exposure device for the drums 4 of the respective image forming units 3, and an intermediary transfer belt unit 10. The respective color toner images are primary-transferred superposedly from the drums 4 in the respective image forming units 3 onto a transfer belt 11. By this, on the belt 11, the superposed toner images of the four colors of Y+M+C+Bk are formed. Incidentally, an electrophotographic process and an image forming operation of the image forming portion 2 are well known, and therefore, will be omitted from description thereof.

On the other hand, a single sheet of the recording materials P is fed from either one of sheet feeding cassettes, 12 and 13 which are provided in a multistage arrangement or from a manual feeding tray 15 by an operation of a sheet feeding roller 16. The sheet P passes through a feeding path 17 including a registration roller pair 18, and is introduced, by the registration roller pair 18, at predetermined control timing into a secondary transfer portion 20 which is a press-contact nip between a secondary transfer roller 19 and the transfer belt 11. By this, the superposed four-color toner images on the transfer belt 11 are successively secondary-transferred collectively onto the sheet P being nipped and fed through the secondary transfer portion 20.

The sheet P is guided by a feeding guide plate 21 and is introduced into a fixing device (image heating apparatus: fixing portion) 22, so that an unfixed toner image on the sheet P is fixed as a fixed image by heating and pressure. In the case of one-side printing mode, the sheet P which comes out of the fixing device 22 and which has already been subjected to the one-side printing is discharged onto a discharge tray 24 by a sheet discharging roller pair 23.

In the case of a double-side printing mode, the sheet P which comes out of the fixing device 22 and which has already been subjected to the one-side printing is sent onto the discharge tray 24 by the sheet discharging roller pair 23, and rotation of the sheet discharging roller pair 23 is reversed immediately before a trailing end portion of the sheet P passes through the sheet discharging roller pair 23. By this, the sheet P is switched back and is introduced into a double-side (printing) feeding path 25. Then, the sheet P is in a front/back reversed state and is fed again to the registration roller pair 18, and thereafter passes through the path of the secondary transfer portion 20, the fixing device 22 and the sheet discharging roller pair 23 and is discharged as a double-side print onto the discharge tray 24.

In the case of a monochromatic printing mode, of the above-described four image forming units 3, image formation is carried out in the image forming unit necessary for forming a monochromatic image, and the drums 4 in unnecessary image forming units idle.

In this printer 1, on an upper right side of a printer main assembly (apparatus main assembly) 1A on the drawing, an opening 1B (part (b) of FIG. 2) having access to at least the fixing device 22 is provided. Further, an openable door (openable member) 26 movable between a closed position 26A (part (a) of FIG. 2) where this opening 1B is closed and an open position 26B (part (b) of FIG. 2) where the opening 1B opens is provided. The openable door 26 in this embodiment is openable, closable and rotatable, relative to the printer main assembly 1A, about a hinge shaft 27, as a rotation center, at a lower portion.

The openable door 26 is prevented from opening and is held by a locking mechanism (not shown) when the openable door 26 is sufficiently closed to the closed position 26A relative to the printer main assembly 1A as shown in part (a) of FIG. 2. The printer 1 is capable of performing the image forming operation in a state in which the openable door 26 is closed.

The openable door 26 prevented from opening can be sufficiently opened and rotated from the closed position 26A to a predetermined open position 26B as shown in part (b) of FIG. 2 by lock release of the locking mechanism. By opening the openable door 26, a sheet feeding path is opened at the opening 1B of the printer main assembly 1A is opened, so that it is possible to easily access a jammed sheet in a sheet feeding path including the fixing device 22. Further, it becomes possible to have mounting and dismounting access to a mounting portion 1C of the fixing device 22 relative to the printer main assembly 1A.

(2) Fixing Device

Figure 3:
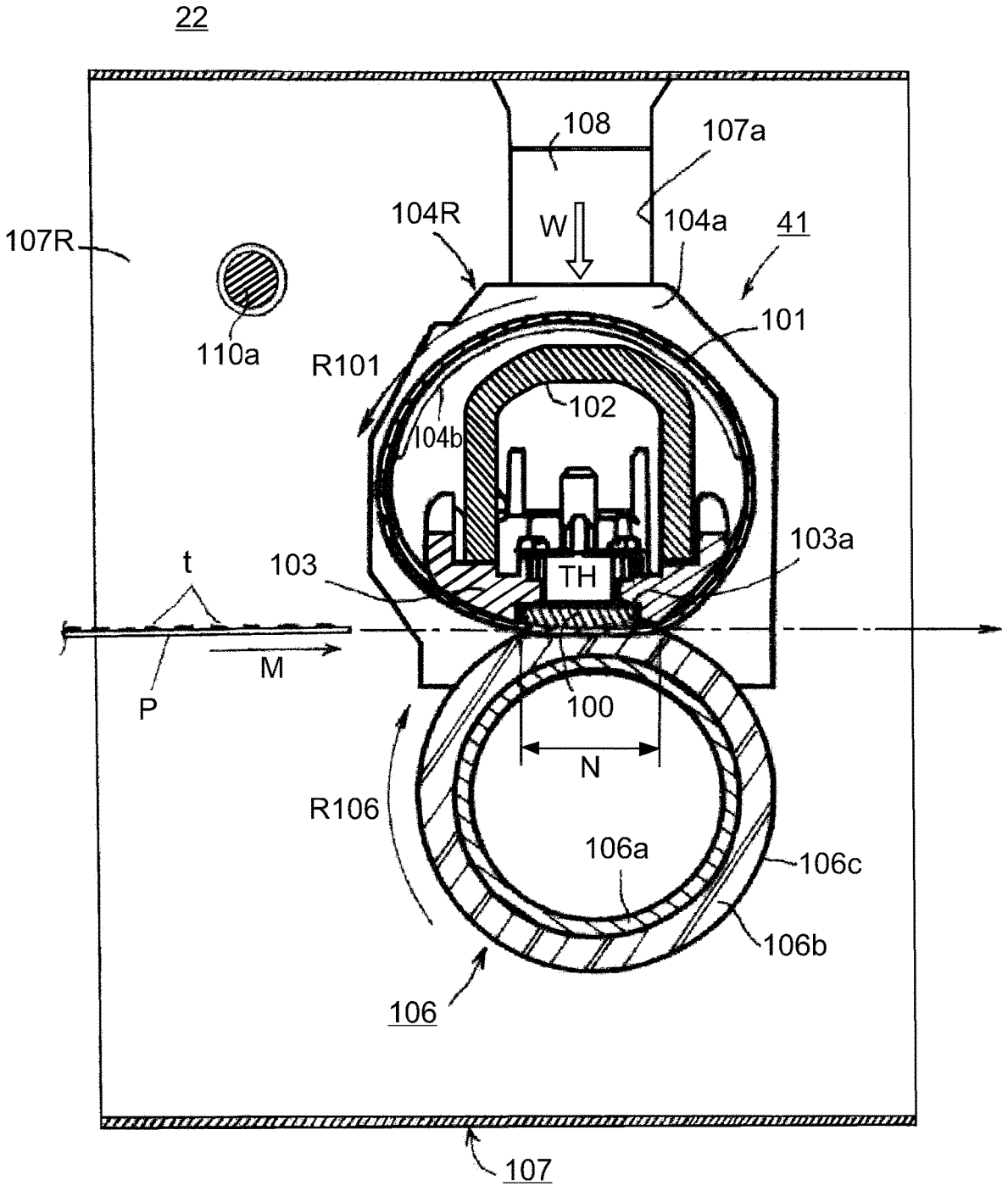
FIG. 3 is an enlarged schematic cross-sectional view of a principal part of a fixing device similarly in the Embodiment 1.

FIG. 3 is an enlarged schematic cross-sectional view of a principal part of the fixing device 22. This fixing device 22 is an on-demand fixing device (ODF fixing device) of a film (belt) heating type and a pressing member driving type. A basic structure and a fixing operation of the fixing device 22 are well known and therefore will be briefly described.

This fixing device 22 is roughly includes a film unit 41, a pressing roller 106 and a device casing 107 in which this film unit 41 and the pressing roller 106 are assembled and accommodated. A fixing film (one rotatable member) 101 and the pressing roller (the) other rotatable member 106 of the film unit 41 function as a pair of rotatable members for forming a nip N. The nip N is a portion where the sheet P carrying unfixed toner images t thereon is nipped and fed and the toner images t are fixed by heat and pressure.

(2-1) Film Unit

The film unit 41 is an assembly of a cylindrical fixing film 101 as a fixing member, a ceramic heater 100, a heater holder 103 holding this heater, a pressing stay 102, fixing flanges 104(F,R) at opposite end portions, and the like.

1) Fixing Film

The fixing film (hereinafter referred to as a film) 101 is a cylindrical member (endless belt) which has a heat-resistant property that heat is transmitted to the sheet P and which has flexibility, and is a film with a four-layer composite structure including, from an outside to an inside, a parting layer, an elastic layer, a base layer and an inner surface coating layer.

The parting layer is capable of using a fluorine-containing resin material of 100 μm or less, preferably 20-70 μm, in thickness. For example, as the fluorine-containing resin layer, it is possible to cite PTFE, PFA, and the like, for example. The elastic layer is capable of using a rubber material of 1000 μm or less, preferably 500 μm or less, in terms of a thickness in order to make thermal capacity small. For example, it is possible to cite a silicone rubber, a fluorine-containing rubber, and the like.

The base layer is capable of using a heat-resistant material of 100 μm or less, preferably 50 μm or less and 20 μm or more in terms of a thickness. For example, it is possible to use a metallic film of SUS, nickel or the like, and a resin material such as polyimide. The inner surface coating layer is a resin layer having a heat-resistant property. For example, it is possible to cite polyimide, polyimideamide, PEEK, PTFE, FEP, PFA, and the like.

2) Ceramic Heater

The ceramic heater (hereinafter referred to as a heater) 100 is a heating means (heating member) for the film 101, and is an elongated plate-like member extending along a width direction (longitudinal direction) of the film 101. The heater 100 has a basic structure including an elongated thin plate-like ceramic substrate and an energization heat generating resistor layer provided on a surface of the substrate and is a low thermal capacitance heater increasing in temperature with a characteristic such that a temperature of the heater 100 abruptly rises as a whole by energization to the heat generating resistor layer.

3) Heater Holder

The heater holder (hereinafter referred to as a holder) 103 is a member for fixedly supporting the heater 100 and has a substantially semicircular trough shape in cross-section, and is an elongated member extending along the width direction of the film 101. The heater 100 is engaged in a groove hole 103*a* formed on an outer surface side of the holder 103 along a longitudinal direction of the holder 103 and is bonded to the holder 103. The holder 103 is a member having a heat-resistant property and a heat-insulating property and an electrically insulating property, and a material, with a good insulating property and a good heat-resistant property, such as phenolic resin, polyimide resin, polyamide resin, polyamideimide resin, PEEK resin, PES resin, PPS resin, PFA resin, PTFE resin, LCP resin, or the like is used.

4) Pressing Stay

The pressing stay (hereinafter referred to as a stay) 102 is provided inside (on an opposite side from the heater 100 side), and is a member which backs up the holder 103 and which includes a rigid member long in the widthwise direction of the film 101. A metal stay having a U-character shape in cross-section is used.

5) Fixing Flange

The film 101 includes as an inside member, an assembly of the above-described heater 100, holder 103 and stay 102, and is externally engaged with (fitted around) the inside member loosely. Longitudinal end portions of the holder 103 and the stay 102 are projected outwardly through openings of longitudinal end portions of the film 101 in a predetermined manner. Further, on both the projected portions on one end side and on the other end side, the fixing flanges 104F and 104R provided on one end side and the other end side are mounted (engaged). In FIG. 3, the fixing flange 104R on the other end side is in sight.

Figure 5:
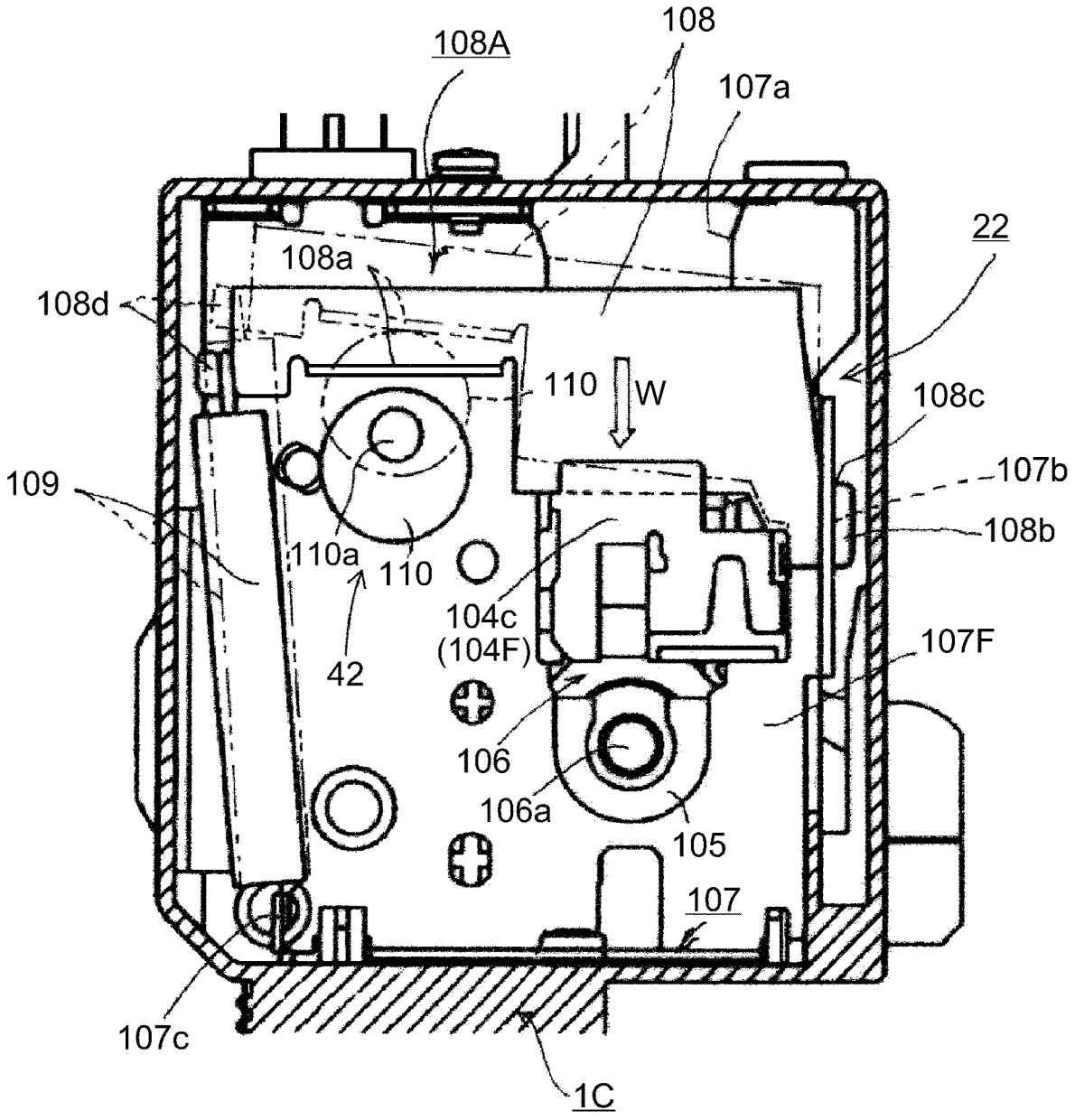
FIG. 5 is a structural illustration of a pressing mechanism of the fixing device on one end side.

The fixing flanges 104F and 104R are restricting members for restricting longitudinal movement and a circumferential shape of the film 101, and as a material thereof, a liquid crystal polymer resin material having a heat-resistant property and a sliding property. Each of the fixing flanges 104F and 104R includes a flange portion (flange seat portion) 104*a*, a film end portion guiding portion 104*b* positioned on an inner surface side of the flange portion 104*a*, and a portion-to-be-urged 104*c* positioned on an outer surface side of the flange portion 104*a*. In FIG. 5 described later, the portion-to-be-urged 104*c* of the fixing flange 104F is in sight.

The film 101 is positioned between the opposing flange portions 104*a* of the fixing flanges 104F and 104R provided on one end side and the other end side. By this, movement of the film 101 in the widthwise direction is restricted. The film end portion guiding portion 104*b* is a portion for holding the cylindrical shape of the film 101 by supporting an inner peripheral surface of the film 101 at the widthwise end portions (portion for stabilizing a rotation locus of the film 101). The portion-to-be-urged 104*c* is a portion for receiving a predetermined pressing force W from a pressing member (pressing lever) 108 (FIG. 5) described later.

(2-2) Pressing Roller

The pressing roller 106 is constituted by a core metal 106*a* and a heat-resistant elastic layer 106*b* at a silicone rubber, a fluorine-containing rubber, a fluorine-containing resin, or the like, which is molded and coated concentratedly and integrally around the core metal, and as a surface layer, a parting layer 106*c* is provided. The parting layer 106*c* is capable of using a fluorine-containing resin material of 100 μm or less, preferably 20-70 μm, in thickness. For example, as the fluorine-containing resin layer, it is possible to cite PTFE, PFA or the like, for example.

The pressing roller 106 is provided by being rotatably supported opposite end portions of a core metal 106*a* by side plates 107F and 107R of a device casing 107 on one end side and on the other end side, respectively, through bearing members 105 (FIG. 5) comprising a heat-resistant resin such as PEEK, PPS, LCP or the lie.

(2-3) Assembling of Film Unit, Pressing Mechanism and Pressing Releasing Mechanism A film unit 41 is disposed substantially in parallel to the pressing roller 106 while being opposed to the pressing roller 106 on the heater 100 side thereof. The fixing flanges 104F and 104R of the film unit 41 on one end side and on the other end side engage base portions of the portions-to-be-urged 106*c* with slit engaging portions 107*a* provided, in a mirror symmetry manner, in the side plates 107F and 107R of the device casing 107 on one end side and on the other end side, respectively. The portions-to-be-urged 106*c* of the fixing flanges 104F and 104R on the one end side and on the other end side project toward outsides of the side plates 107F and 107R on one end side and on the other end side, respectively.

By this engagement, the fixing flanges 104F and 104R on one end side and on the other end side, i.e., the film unit 41 is held between the side plates 107F and 107R in a state in which the film unit 41 is slidable (movable) in a direction of moving toward a rotational axis of the pressing roller 106 and in a direction of moving away from the rotational axis of the pressing roller 106.

Further, on the portions-to-be-urged 106*c* on one end side and on the other end side, predetermined pressing forces W are exerted by pressing members 108 of pressing mechanisms 108A (FIG. 5) provided outside the side plates 107F and 107R on one end side and on the other end side, respectively. By the pressing forces W, the stay 102 and the holder 103 are urged in a direction of the pressing roller 106, so that the heater 100 and a part of the holder 103 are press-contacted to the pressing roller 106 against elasticity of the elastic layer 106*b* via the film 101. By this, between the film 101 and the pressing roller 106, the nip having a predetermined width is formed with respect to the sheet feeding direction M.

The pressing mechanism 108A in this embodiment will be described by FIG. 5. FIG. 5 shows the pressing mechanism 108A for the portion-to-be-urged 106*c* of the fixing flange 104F on one end side. Outside the side plate 107F on one end side, the pressing member (pressing lever) 108 is provided. A projection 108*b* which is one end portion of this pressing member 108 is inserted into an engaging hole 107*b* of the side plate 107F side, and the pressing member 108 is swingable (movable) about, as a hinge portion 108*c*, an engaging portion between this projection 108*b* and the engaging hole 107*b*. The pressing member 108 passes through an upper side of the portion-to-be-urged 106*c* and is extended to an opposite side to the hinge portion 108*c* side on FIG. 5.

Further, between an external end portion 108*d* and a spring locking portion 107*c* at a lower portion of the side plate 107F, a spring 109 as a pressing elastic member is stretched. By a tensile force of this spring 109, the pressing member 108 is press-contacted to the portion-to-be-urged 106*c*, so that the fixing flange 104F is urged (pressed) in the pressing roller 106 direction.

Although the pressing mechanism for the portion-to-be-urged 106*c* of the fixing flange 104R on the other end side is omitted from illustration, the pressing mechanism 108A similar to the pressing mechanism 108A on one end side of FIG. 5 described above is provided outside the side plate 107R in a mirror symmetry manner.

In FIG. 5, 42 is a pressing releasing mechanism. The pressing releasing mechanism 42 moves the pressing members 108 of the pressing mechanisms 108A on the side plate 107F side and the side plate 107R side as described above, so that the nip N is switched between a pressed state and a pressing released state.

The pressing releasing mechanism 42 includes a cam shaft 110*a* which is stretched and rotatably bearing-supported between the side plate 107F and the side plate 107R. At one end portion of this cam shaft 110*a* projecting from the side plate 107F toward the outside and at the other end portion of this cam shaft 110*a* projecting from the side plate 107R toward the outside, eccentric cams 110 which have the same shape and which are positioned on one end side and on the other end side are fixedly provided at the same phase, respectively. Accordingly, the eccentric cams 110 on one end side and on the other end side are rotated together with the cam shafts 110*a* with the same phase by rotation of the cam shafts 110*a*.

The eccentric cams 110 on one end side and on the other end side are positioned corresponding to cam contact surfaces 108*a* formed on the pressing members 108 in the pressing mechanisms 108A on the side plate 107F side and on the side plate 107R side, respectively. By rotation control of the eccentric cams 110, in the pressing mechanisms 108A on the side plate 107F side and on the side plate 107R side, cam surfaces are contacted to or separated from the cam contact surfaces 108*a* of the pressing members 108, respectively, so that pressing and pressing release of the nip N are carried out. A drive transmission system for rotating the cam shafts 110*a* will be described later.

During pressing of the nip N, the phase of the eccentric cam 110 is such that as shown by a solid line of FIG. 5, the cam surface is prevented from contacting the cam contact surface 108*a* of the pressing member 108. By this, the pressing members 108 press the portions-to-be-urged 106*c* of the fixing flanges 104F and 104R by an elastic force of the spring 109, so that the nip N is placed in the pressed state. The nip N is retained in the pressed state as long as the eccentric cams 110 are in the phase shown by the solid line of FIG. 5 and rotation thereof is at rest.

On the other hand, during the pressing release, the cams 110 are rotated substantially 180° from the state shown by the solid line of FIG. 5 to a state shown by a chain double-dashed line of FIG. 5. By this, the cam surfaces of the cams 110 contact the cam contact surfaces 108*a* of the pressing members 108, so that the pressing members 108 are pushed up from the portions-to-be-urged 106*c* of the fixing flanges 104F, 104R against the elastic force of the spring 109 as shown by the chain double-dashed line. By this, the pressing of the nip N is released. The nip N is retained in the pressing released state as long as the eccentric cams 110 are in the phase shown by the chain double-dashed line of FIG. 5 and rotation of thereof is at rest.

(2-4) Fixing Operation

In a state in which the nip N is placed in the pressed state, the pressing roller 106 is rotationally driven as a driving rotatable member by the drive transmission system described later at a predetermined peripheral speed in the clockwise direction of an arrow R106 in FIG. 3. By the rotational drive of the pressing roller 106, the film 101 of the film unit 41 is rotated in the counterclockwise direction of an arrow R101 while the inner surface thereof slides on and in intimate contact with the heater 100 and a part of the holder 103 in the nip N.

The heater 100 is supplied with electric power from an energizing portion (not shown), controlled by the controller 30. By this energization, the heater 100 generates heat and increases in temperature with an abrupt rising characteristic. A temperature of the heater 100 is detected by a thermistors TH. Detection temperature information of the thermistor TH is fed back to the controller 30. The controller 30 controls electric power supplied from the energizing portion to the heater 100 so that the temperatures of the heater 100 is a predetermined target temperature.

The sheet P fed from the image forming portion 2 to the fixing device (fixing portion) 22 while carrying the unfixed toner image t thereon enters the nip N, and then is nipped and fed in the nip N. By this, heating and pressing of the sheet P are simultaneously carried out in the nip N, so that the toner image t is fixed as a fixed image on the sheet P. The sheet P passed through the nip N is separated from the film 101 by curvature separation and is discharged to an outside of the fixing device 22.

(3) Drive Switching Device

Figure 4:
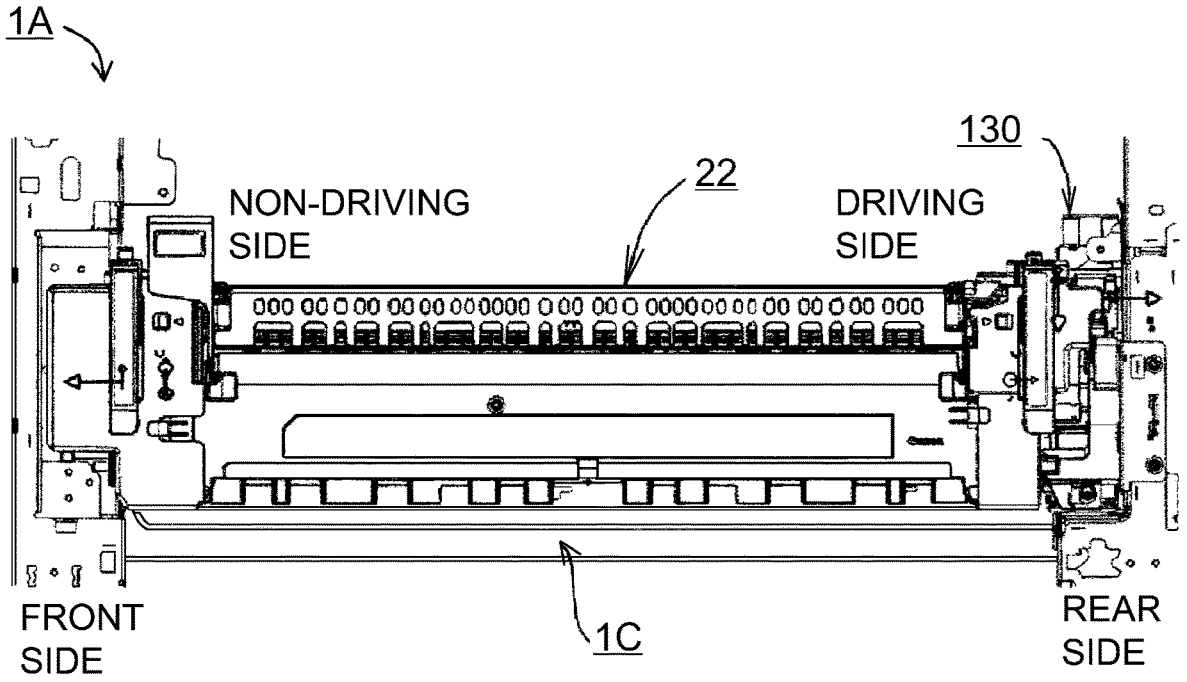
FIG. 4 is a state view in which the fixing device is mounted in a fixing device mounting portion of an image forming apparatus main assembly.

FIG. 4 is a state view in which the fixing device 22 is mounted in a fixing device mounting portion 1C of the printer main assembly 1A. In FIG. 5, 1C is the fixing device mounting portion in the printer main assembly 1A. In this embodiment, the fixing device 22 is such that one end side thereof with respect to a longitudinal direction is a non-driving side and the other end side is a driving side. Further, the fixing device 22 is mounted in a predetermined manner such that one end side which is the non-driving side is a front side in the printer main assembly 1A with respect to the fixing device mounting portion 1C of the printer main assembly 1 and the other end side which is the driving side is a rear side.

In a state in which the fixing device 22 is mounted in the fixing device mounting portion 1C of the printer main assembly 1A in the predetermined manner, the fixing device 22 is gear-connected to a drive switching device (drive transmission mechanism) 130 provided so that a driving side is a rear side of the printer main assembly 1A. Further, the pressing roller 106 which is a rotatable driving member of the fixing device 22 is driven via the drive switching device 130 by a motor 131 (FIG. 7) as a driving source which is provided on the printer main assembly 1A side and which is rotatable normally and reversely.

This drive switching device 130 is a drive transmission mechanism for switching a driving force of the normally and reversely rotatable driving source 131 in a first direction and a driving force of the driving source 131 in a second direction to drive of the pressing roller 106 and drive of the pressing releasing mechanism 42 by a gear (unit) with a one-way structure.

Figure 6:
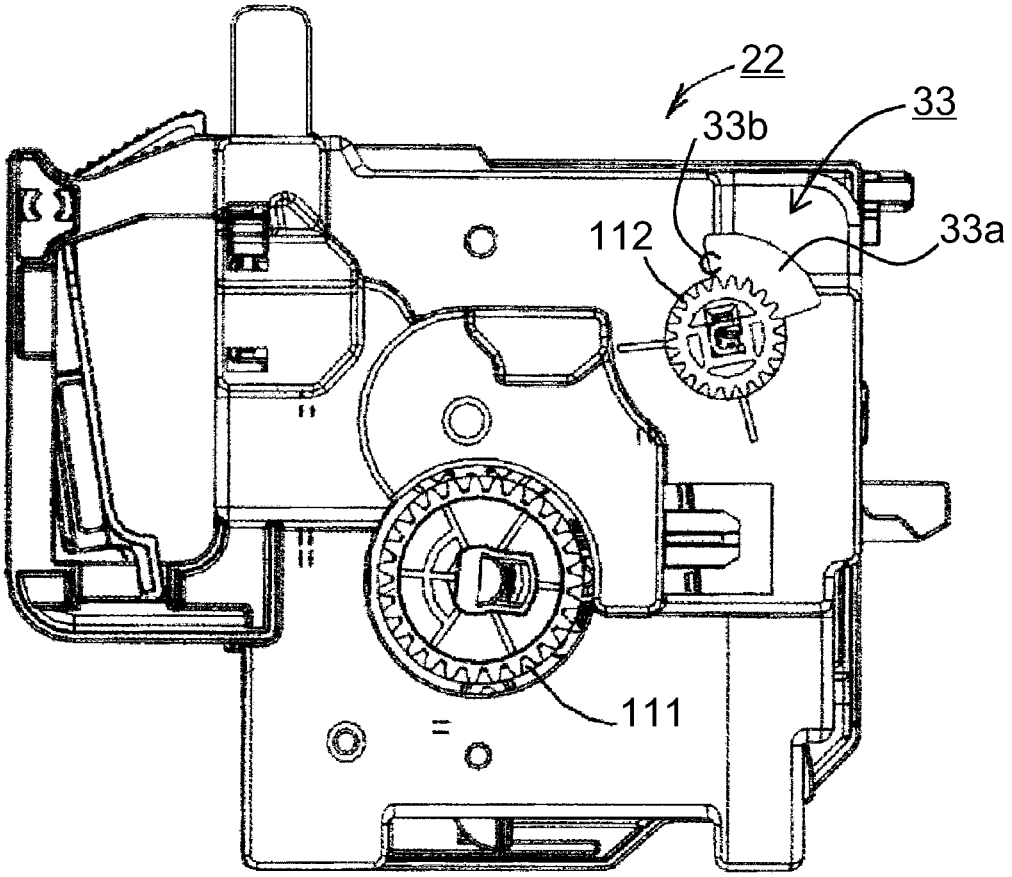
FIG. 6 is an end surface view of the fixing device on a driving side.

The drive switching device 130 is connected to or separated from the gear as a driving portion provided on the driving side of the fixing device 22 with mounting and dismounting of the fixing device 22 relative to the fixing device mounting portion 1C of the printer main assembly 1A. FIG. 6 is an end surface view of the fixing device 22 on the driving side. On the driving side end surface of the fixing device 22, a pressing roller gear 111 as a driving portion and a cam gear 112 are provided.

The pressing roller gear 111 is a feeding driving portion for transmitting drive to the pressing roller 106 as the rotatable driving member for feeding the sheet P in the nip N. Further, the cam gear 112 is a pressing release driving portion for transmitting drive to the cam shaft 110*a* of the pressing releasing mechanism 42. To these respective gears 111 and 112, driving paths of the drive switching device 130 described below are connected, respectively, so as to permit drive transmission, and the drive is transmitted depending on an operation of the drive switching device 130.

Figure 7:
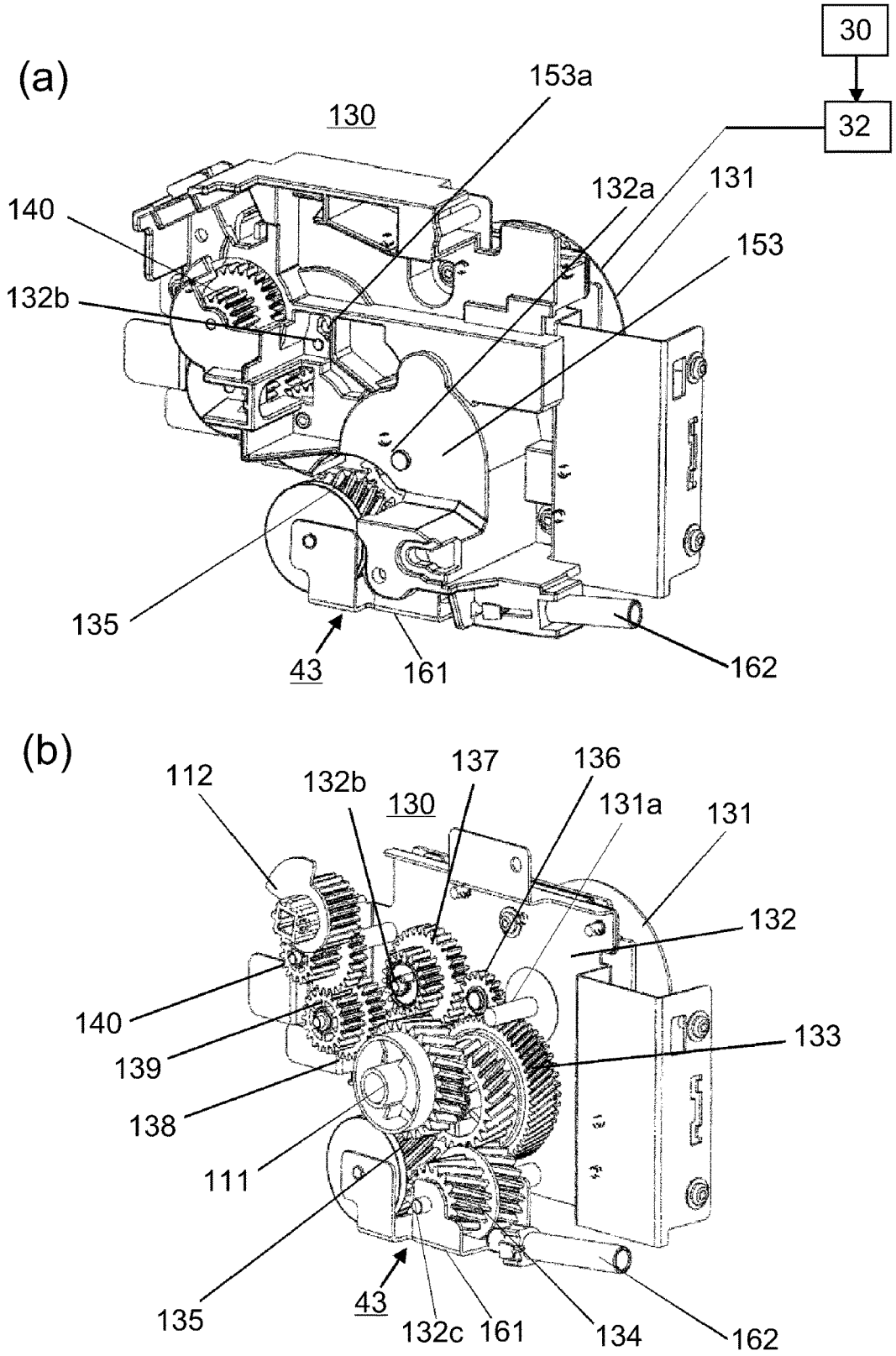
FIG. 7 includes perspective views of a drive switching device.

Part (a) of FIG. 7 is a perspective view of an entirety of the drive switching device 130. Part (b) of the same figure is a perspective view, for easy understanding of a driving train (driving gear train) in the drive switching device 130, in which a driving frame 153 in part (a) is omitted and arrangement of the pressing 111 and the cam gear 112 on the fixing device 22 side are also illustrated.

In the drive switching device 130, the motor 131 as the normally and reversely rotatable driving source and a motor gear 131*a* are mounted to a driving supporting frame 132 with a gear shaft. The driving force of the motor 131 in the first direction or the driving force of the motor 131 in the second direction which is an opposite direction to the first direction is transmitted to a planetary one-way unit 133.

As a drive transmission path from the planetary one-way unit 133 to the pressing roller gear 111, a swingable center gear 134 and a swingable gear 135 are provided in a swingable unit 43. Further, as a drive transmission path from the planetary one-way unit 133 to the cam gear 112, an idler gear 136, a swingable pendulum gear 137 and idler gears 138, 139 and 140 are provided. The driving frame 153 supports one side ends of the above-described respective gears disposed.

The motor 131 is a DC brushless motor capable of rotating normally and reversely and is positioned and fixed to the driving supporting frame 132 on the rear side. Such a motor 131 is rotationally driven normally and reversely by being energized from a motor controller (power source portion) 32 controlled by the controller 30. Incidentally, the motor 131 is not limited to the DC brushless motor, but may also be another motor such as a stepping motor, for example, if the motor can be rotated normally and reversely.

(3-1) Planetary One-Way Gear Unit

Figure 8:
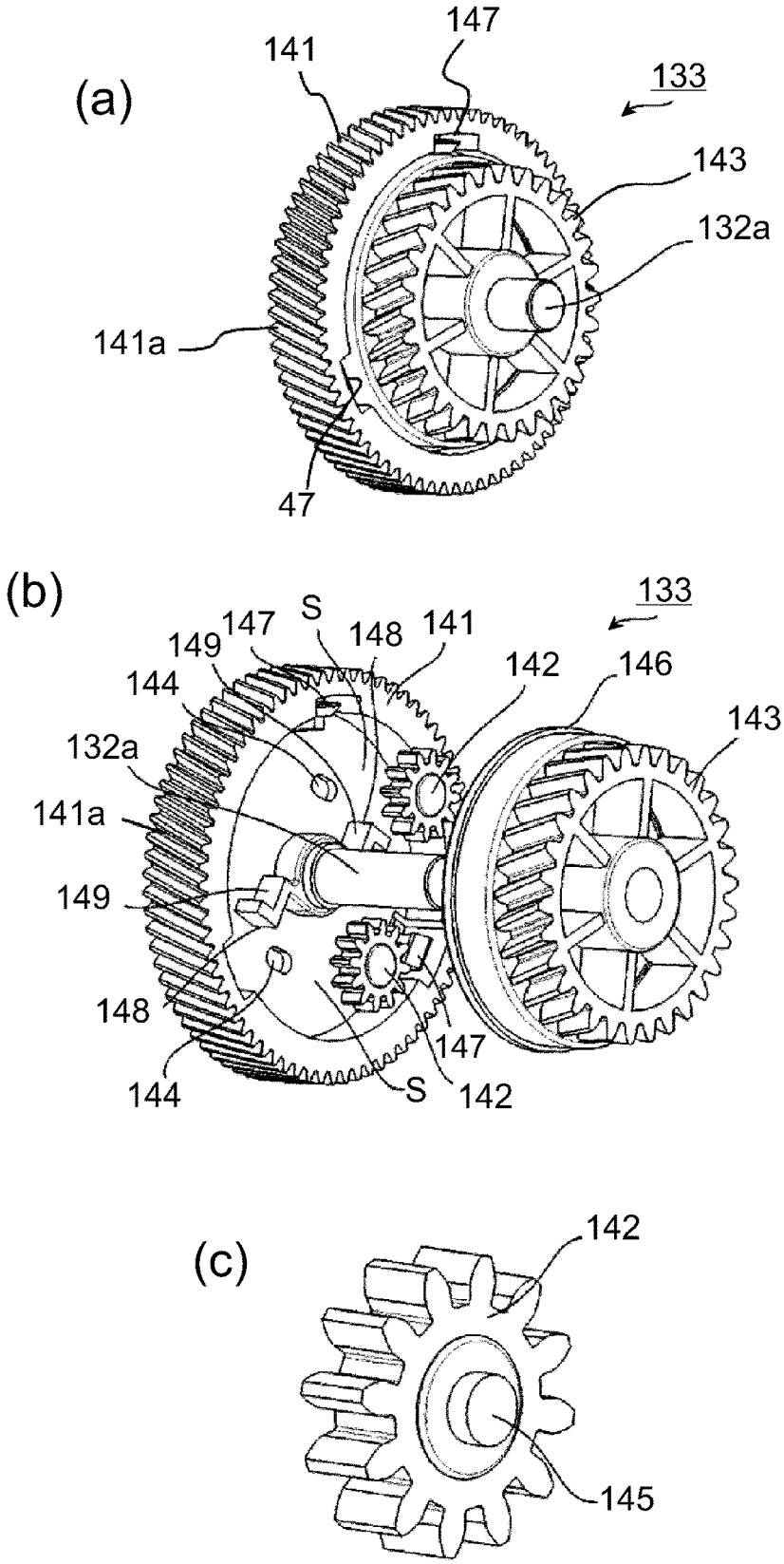
FIG. 8 includes structural views of a planetary one-way unit.

The planetary one-way unit 133 will be described using a planetary one-way unit view of FIG. 8 and an operational view of the planetary one-way unit 133 of FIG. 9. Part (a) of FIG. 8 is a perspective view of the planetary one-way unit 133, and part (b) of FIG. 8 is an exploded perspective view of the planetary one-way unit 133. As shown in parts (a) and (b) of FIG. 8, the planetary one-way unit 133 is loosely engaged (fitted) around a rotation shaft 132*a*. The planetary one-way unit 133 includes an input gear 141, planetary gears 142 and an output gear 143.

The input gear 141 is formed in a recessed shape by an annular rib, and a tooth surface 141*a* is formed at an outer periphery of the annular rib. This tooth surface 141*a* and the motor gear 131*a* engage with each other. In a space S enclosed by the annular rib of the idler gear 141, two planetary gears 142 are provided. The space S inside the idler gear 141 is covered with the output gear 143.

As shown in part (c) of FIG. 8, on a surface of the planetary gear 142 opposing the input gear 141, a boss (projection) 145 is provided. The planetary gear 142 and the boss 145 are coaxial with each other. The input gear 141 is provided with an elongated-shaped groove 144 at a surface where the space S is formed. The boss 145 slidably engages with the groove 144. The planetary gears 142 selectively switch connection or non-connection between the input gear 141 and the output gear 143 by a relative rotational direction between the input gear 141 and the output gear 143.

As shown in part (b) of FIG. 8, on the surface of the input gear 141 opposing the planetary gears 142, a stopper wall (locking member) 149 is provided. The stopper wall 149 is provided with an edge portion 148. On the surface of the input gear 141 opposing the output gear 143, hook portions 147 are provided. The hook portions 147 catch an outer diameter portion 146 of the output gear 143 and rotatably hold the output gear 143 so that the output gear 143 is not separated from the input gear 141 in a thrust direction.

Figure 9:
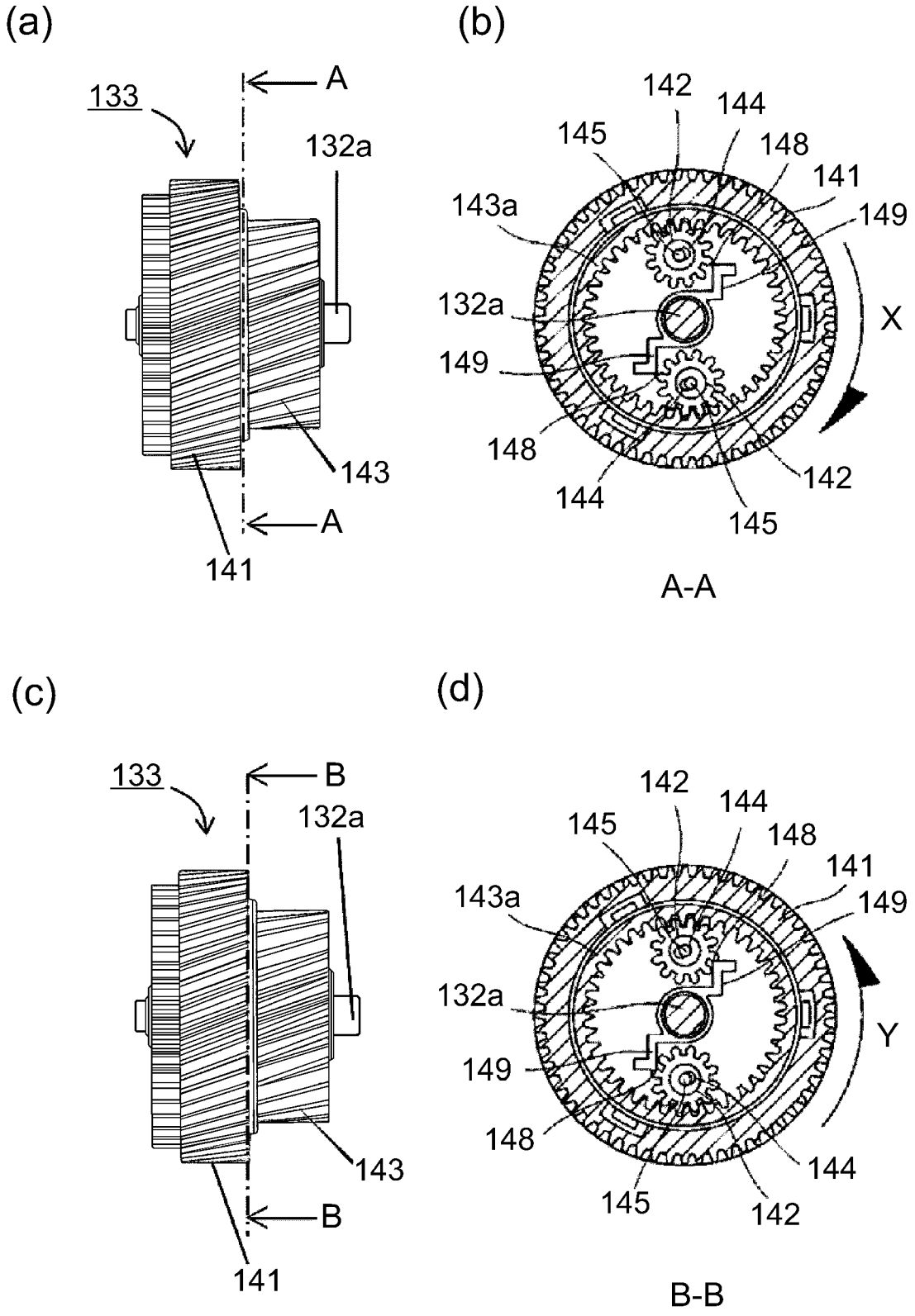
FIG. 9 includes operational views of the planetary one-way unit.

Part (b) of FIG. 9 is a view showing a state in which drive between the input gear 141 and the output gear 143 is disconnected and is an A-A sectional view of part (a) of FIG. 9. Part (d) of FIG. 9 is a view showing a state in which the drive between the input gear 141 and the output gear 143 is transmitted and is a B-B sectional view of part (c) of FIG. 9.

As shown in part (b) of FIG. 9, when the drive is inputted to the input gear 141 in an arrow X direction, the stopper wall 149 integral with the input gear 141 also moves in the arrow X direction, so that the stopper wall 149 is separated from the planetary gears 142. Then, the other end of the groove 144 contacts the boss 145 and causes the planetary gears 42 to revolve about the rotation shaft 132*a*.

At this time, the tooth surfaces of the planetary gears 142 engage with an internal wall 143*a*, but the edge portions 148 are separated from the tooth surfaces of the planetary gears 142. That is, in a state in which the bosses 145 are urged against the other ends of the grooves 144, positions of the planetary gears 142 are restricted, and the planetary gears 142 and the internal tooth 143*a* are set so as to provide a proper engagement center distance, so that the planetary gears 142 perform rotational motion (rotate) about the bosses 145. For this reason, a driving force from the input gear 141 is not transmitted to the output gear 143.

On the other hand, as shown in part (d) of FIG. 9, when the drive is inputted to the input gear 141 in an arrow Y direction, the stopper wall 149 integral with the input gear 141 also moves in the arrow Y direction. Then, the stopper wall 149 slides the planetary gears 142 until the bosses 145 move to one ends of the grooves 144. By this, the planetary gears 142 are locked by the stopper wall 149 and perform rotational motion (revolve) about the planetary shaft 132*a* in a state (state in which the planetary gears 1422 do not rotate) of being substantially integral with the input gear 141. At this time, the planetary gears 142 are held by engaging the bosses 145 in the grooves 144, so that the tooth surface of the planetary gears 142 engage with the internal tooth 143*a* of the output gear 143.

In a state in which the bosses 145 are urged against one ends of the grooves 144, the tooth surfaces of the planetary gears 142 connect the stopper wall 149 and the output gear 143 in a state in which the tooth surfaces of the planetary gears 142 enter between the edge portions 148 and the internal tooth 143*a*. For this reason, the planetary gears 142 do not rotate, so that the driving force from the input gear 141 is transmitted to the output gear 143 via the planetary gears 142.

(3-2) Swingable Pendulum Gear

The swingable pendulum gear 137 will be described using a swingable pendulum gear structural view of FIG. 10 and an operational view of the swingable pendulum gear of FIG. 11. In parts (a) and (c) of FIG. 11, a position of the swingable pendulum gear is principally shown, but in parts (b) and (d) of FIG. 11, a positional relationship between a projection 151*b* and a restricting groove 153*a* provided in the swingable frame 153 is shown.

Figure 10:
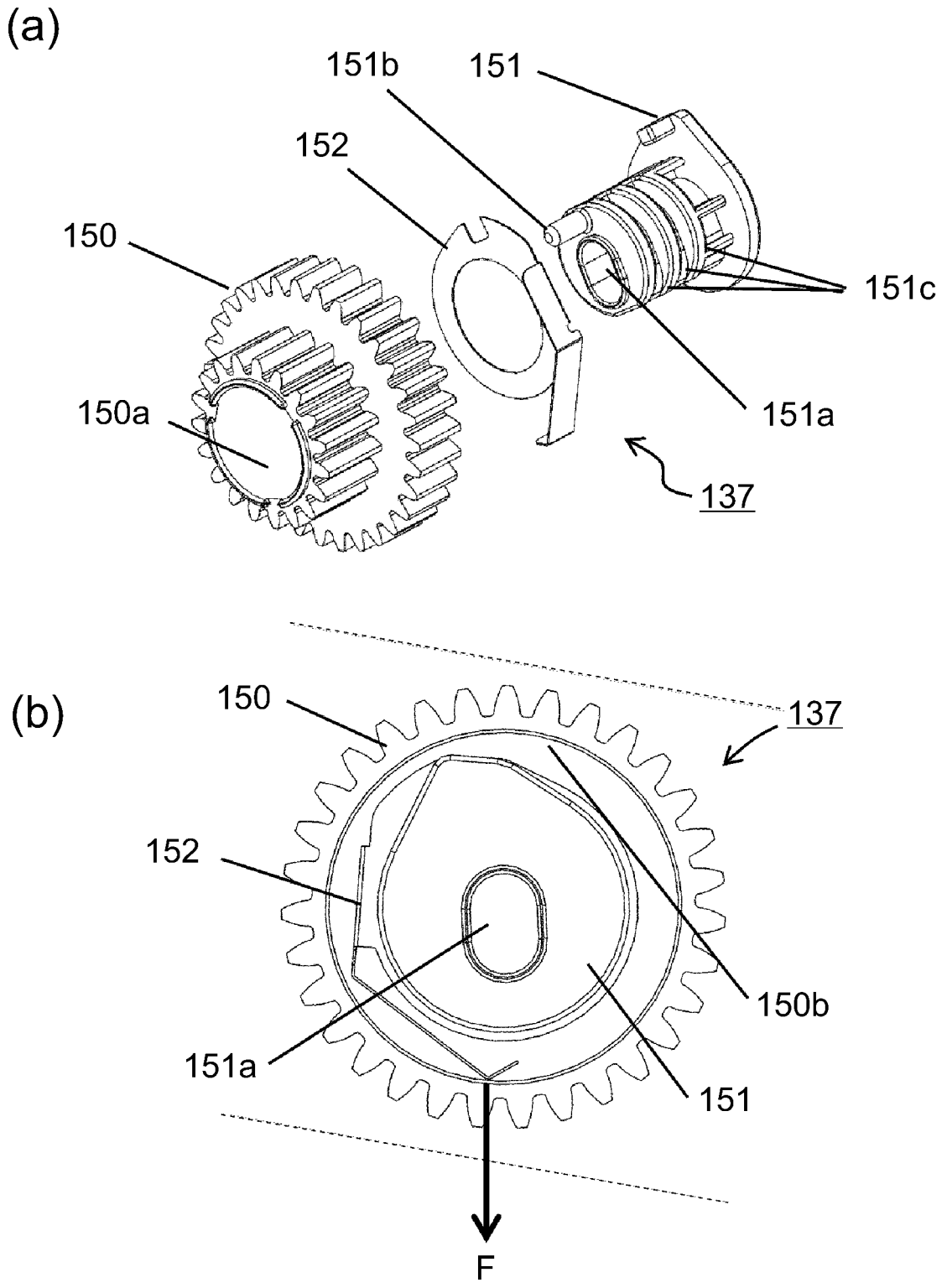
FIG. 10 includes structural views of a swingable pendulum gear.

The swingable pendulum gear 137 includes a gear member 150, a holder member 151 and an elastic member 152 as shown in part (a) of FIG. 10. The gear member 150 is formed in a cylindrical shape, and a gear tooth is formed on an outer peripheral surface of the gear member 150, and as shown in part (a) of FIG. 11, the gear member 150 engages with the idler gears 136 and 138.

The hold member 151 rotatably supports the gear member 150 by inserting and fitting circular ribs 151*c* into an inner peripheral surface 150*a* of the gear member 150.

The elastic member 152 is constituted by a leaf spring, and as shown in part (b) of FIG. 10, not only is fixed to the holder member 151 at one end portion thereof but also is contacted at the other end side thereof to an inner peripheral surface 150*b* of a large diameter portion of the gear member 150 in a state in which the elastic member 152 is elastically urged in an arrow F direction. Then, a rotational load is imparted to the gear member 150 when the gear member 150 is swung, so that a swinging force is generated in the swingable pendulum gear 137.

Further, in the holder member 151, an elongated hole 151*a* which penetrates through the gear member 150 in an axial direction and which is long in a direction perpendicular to this axial direction is formed. Further, as shown in FIG. 11, by passing a shaft 132*a*, through the elongated hole 151*a*, provided so as to project from the pressing supporting frame 132, so that the holder member 151 is movably held.

Figure 11:
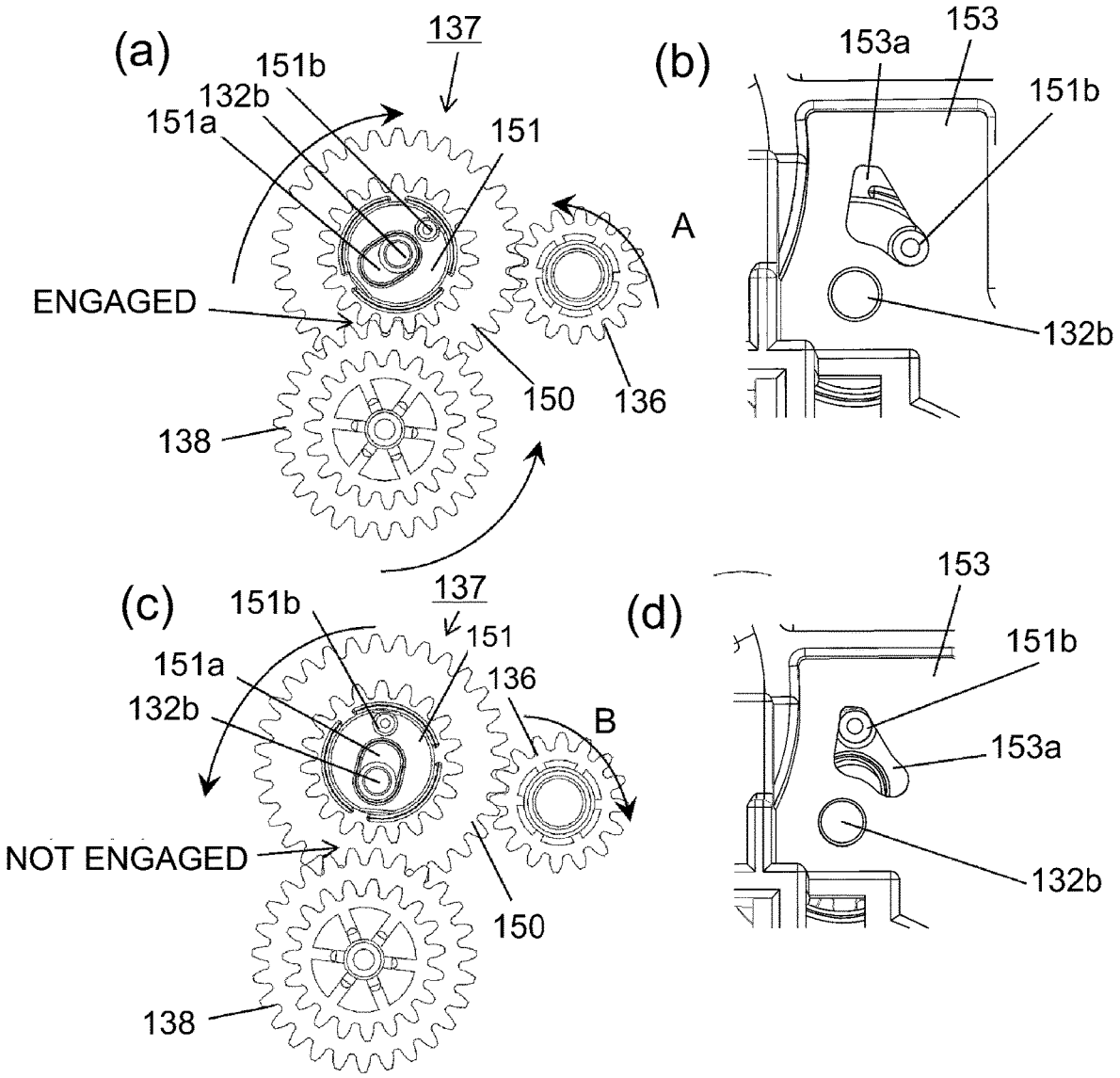
FIG. 11 includes operational views of the swingable pendulum gear.

When the idler gear 136 is rotated in an arrow A direction of part (a) of FIG. 11, a rotational driving force is transmitted to the gear member 150 in the swingable pendulum gear 137 engaging with this idler gear 136.

In this case, the swingable pendulum gear 137 is moved, even when the swingable pendulum gear 137 is in a position of part (b) of FIG. 11, so as to be in a position of part (a) of FIG. 11 by the rotational load by the elastic member 152 and a driving force received from the idler gear 136 by the gear member 150. By this, the gear member 150 engages with the idler gear 138 and transmits the drive. That is, when the idler gear 136 is rotated in the arrow A direction as in part (a) of FIG. 11, the swingable pendulum gear 137 is swingable between the elongated hole 151*a* and the shaft 132*b*, and therefore, even when the swingable pendulum gear 137 is in the position of part (b) of FIG. 11, the swingable pendulum gear 137 is moved so as to be in the position of part (a) of FIG. 11.

Further, the holder member 151 is provided with a projection 151*b*, and as shown in part (b) of FIG. 11, the projection 151*b* is extended into a restricting groove 153*a* formed on the driving frame 153. This restricting groove 153*a* restricts a swingable range of the swingable pendulum gear 137 by engagement with the projection 151*b*. Accordingly, the swingable pendulum gear 137 does not swing further by abutment of the projection 151*b* against a part of the restricting groove 153*a*. Thereafter, the gear member 150 rotates about, as a rotation axis, the ribs 151*c* provided on the holder member 151, irrespective of a rotation load of the elastic member 152.

Further, as shown in part (c) of FIG. 11, in the case where the idler gear 136 is rotated in an arrow B direction, the swingable pendulum gear 137 performs a swing operation from a position shown in part (a) of FIG. 11 to a position shown in part (b) of FIG. 11 and does not engage with the idler gear 138 and shuts off transmission. The projection 151*b* and the restricting groove 151*a* at that time are in positions of part (d) of FIG. 11, and restrict movement of the swingable pendulum gear 137.

(3-3) Fixing Drive

The drive switching device 130 in this embodiment switches the drive of the pressing roller 106 and the drive of the pressing releasing mechanism through the normal and reverse rotation of the motor 131 by the planetary one-way unit 133 and the swingable pendulum gear 137 which are described above.

Fixing drive is a drive transmission form in which the driving force is not transmitted to the pressing releasing mechanism 42 but is transmitted to the pressing roller 106, so that the pressing roller 106 is rotationally driven. In this embodiment, the controller 30 causes the motor 131 to be rotated in a first direction during the fixing drive. The driving force in the first direction is inputted from the motor gear 131*a* to the input gear 141 of the planetary one-way unit 133. The rotational direction of the input gear 141 at this time is an arrow Y direction of part (d) of FIG. 9.

The rotational direction Y of this input gear 141 is a direction in which the driving force is transmitted to the output gear 143 as described above. Further, from this output gear 143, the driving force is transmitted to the pressing gear 111 via the swingable center gear 134 and the swingable gear 135 of the swingable unit 43. Accordingly, the pressing roller 106 is rotationally driven in a direction of an arrow R106 in FIG. 3.

On the other hand, the rotational direction of the idler gear 136 engaging with the input gear 141 rotating in the arrow Y direction is the arrow B direction of part (c) of FIG. 11. The rotational direction B of this idler gear 136 is a direction in which as described above, the swingable pendulum gear 137 is prevented from engaging with the idler gear 138, so that transmission of the driving force to the idler gear 138 is shut off.

(3-4) Fixing Pressing Release Drive

Fixing pressing release drive is a drive transmission form in which the driving force is not transmitted to the pressing roller 106 but is transmitted to the pressing releasing mechanism 42. In this embodiment, the controller 30 causes the motor 131 to be rotated in a second direction which is an opposite direction to the first direction during the fixing pressing release drive. The driving force in the second direction is inputted from the motor gear 131*a* to the input gear 141 of the planetary one-way unit 133.

The rotational direction of the input gear 141 at this time is an arrow X direction of part (b) of FIG. 9. The rotational direction X of this input gear 141 is a direction in which the driving force is not transmitted to the output gear 143 as described above, so that the output gear 143 is not rotated. Accordingly, to the pressing gear 111, i.e., to the pressing roller 106, the driving force is not transmitted.

On the other hand, the rotational direction of the idler gear 136 engaging with the input gear 141 rotating in the arrow X direction is the arrow A direction of part (a) of FIG. 11. The rotational direction A of this idler gear 136 is a direction in which as described above, the swingable pendulum gear 137 is engaged with the idler gear 138, so that transmission of the driving force to the idler gear 138 is carried out. Then, the driving force is transmitted to the cam gear 112 via the idler gears 138, 139 and 140. By this, rotational drive of the cam shaft 110*a* is carried out. That is, the cam 110 is rotated, so that the nip N is changed from the pressed state to the pressing released state or from the pressing released state to the pressed state.

Here, in the fixing device 22, as shown in FIG. 6, a rotation angle detecting mechanism 33 for the cam gear 112 is provided. The mechanism 33 in this embodiment is constituted by a flag 33*a* rotating integrally with the cam gear 112 and a photo-sensor of which optical path is opened and shut off by that flag 33*a*. This rotation angle detecting mechanism 33 detects a first angle of rotation of the cam gear 112 corresponding to the pressed state of the nip N and detects a second angle of rotation (of the cam gear 112) corresponding to the pressing released state of the nip N. Then, a constitution in which detection information thereof is fed back to the controller is employed.

When the detection information of the first angle of rotation is inputted from the rotation angle detecting mechanism after the drive of the motor 131 in the second direction, the controller 30 discriminates that the nip N is changed from the pressing released state to the pressed state and causes the motor 131 to stop drive thereof. By this, the nip N is retained in the pressed state. Further, when the detection information of the second angle of rotation is inputted from the rotation angle detecting mechanism 33 after the drive of the motor 131 in the second direction, the controller 30 discriminates that the nip N is changed from the pressed state to the pressing released state and causes the motor 131 to stop drive thereof. By this, the nip N is retained in the pressing released state.

In this embodiment, the controller 30 controls the pressing releasing mechanism 42 so that the nip N is retained in the pressing released state during non-printing operation (non-image formation) such as during stand-by of the printer 1, or the like. Further, the controller 30 controls the pressing releasing mechanism 42 so that the nip N is changed from the pressing released state to the pressed state and then is retained in the pressed state, and then carries out the above-described fixing drive. Further, when the controller 30 detects a jam in a printing operation process of the printer 1, the controller 30 not only stops the printing operation due to an emergency but also controls the pressing releasing mechanism 42 so that the nip N is changed from the pressed state to the pressing released state and then is retained in the pressing released state.

(3-5) Swingable Unit 43

The swingable unit 43 is caused to function as a drive shut-off device for shutting off drive so that the pressing releasing mechanism 42 does not operate even when the drive switching device 130 receives drive from the pressing roller 106 side. This swingable unit 43 constitutes a part of a drive transmission gear train of the drive switching device 130, and is movable (swingable) between a drive connection position 43A (part (b) of FIG. 1) where the drive switching device 130 enters the drive transmission gear train and a drive shut-off position 43B (part (b) of FIG. 1) where the drive switching device 130 is separated (disengaged) from the drive transmission gear train.

This swingable unit 43 will be described using a perspective view of a swingable unit of FIG. 1. The swingable unit 43 includes the swingable center gear 134, the swingable gear 135, a swingable roller 164 and a swing supporting plate 161 for holding these. Further, the swingable unit 43 includes a slider 162 and a slider spring 163 which are a moving mechanism (interrelating member) for selectively moving the swingable unit 43 between the drive connection position 43A of part (b) and the drive shut-off position 43B of part (a).

The slider 162 is slidably (movably) held by the driving frame 153 as shown in the perspective view of the drive switching device 130 of part (a) of FIG. 7. The slider swingable 163 is held between the swing supporting plate 161 and the slider 162, and urges the swing supporting plate 161 depending on movement of the slider 162. In the swingable unit 43, a slider free end portion 162*a* is urged by an urging portion 26*a* on an openable door 26 side by closing of the openable door 26. Further, the urging is released by opening the openable door 26.

That is, as an interrelating member, the slider 162 and the slider spring 163 move the swingable unit 43 from the drive transmission position 43A to the drive shut-off position 43B with movement of the openable door 26 from a closed position 26A to an open position 26B. Further, as the interrelating member, the slider 162 and the slider spring 163 move the swingable unit 43 from the drive shut-off P43B to the drive transmission position 43A with movement of the openable door 26 from the open position 26B to the closed position 26A.

Figure 1:
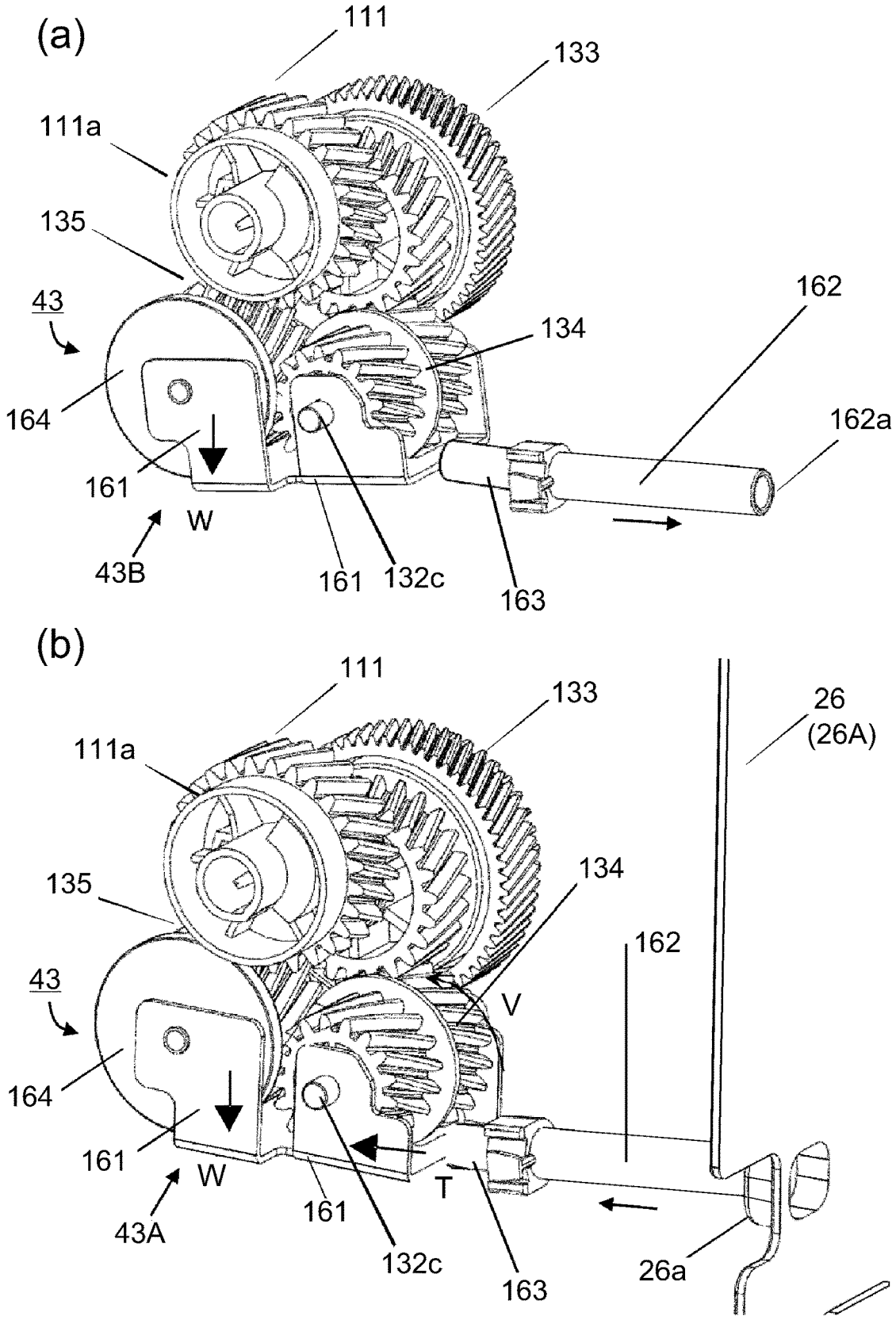
FIG. 1 includes operational views of a swingable in an Embodiment 1.

Part (a) of FIG. 1 is a view showing a state in which the openable door 26 is open and the slider free end portion 162*a* is not pressed by the openable door 25. At this time, by a rotational torque W due to a self-weight is exerted about a shaft 132*c* on the swingable unit 43, gears of the pressing roller gear 111 and the swingable gear 135 are separated from each other so as not to engage with each other. That is, the swingable unit 43 is moved to the drive shut-off position 43B.

When a jammed sheet occurring in the fixing device 22 is subjected to a clearance (removal) process, the openable door 25 is opened in order to access the jammed sheet and the jammed sheet is pulled out. At that time, even when the pressing roller 106 and the pressing roller gear 111 are rotated, drive transmission with the swingable gear 135 is disconnected, and therefore, the gears in the drive switching device 130 are not rotated. That is, the drive is shut off so that the pressing releasing mechanism 42 does not operate.

On the other hand, part (b) of FIG. 1 is a view showing a state in which the openable door 26 is closed, and the slider free end portion 162*a* is pressed by the openable door 26. The slider free end portion 162*a* is moved by being pressed by the openable door 26, and presses the swingable unit 43 via the slider spring 162. By this urging (pressing), a rotational torque T acts about the shaft 132*c*, and T>W and therefore, the swingable gear 135 and the pressing roller gear 111 engage with each other. At this time, the swingable roller 164 and the outer diameter portion 111*a* of the pressing roller gear 111 contact each other, whereby a center distance of the gears is kept constant. That is, the swingable unit 43 is moved to the drive connection position 43A, so that the fixing drive becomes possible.

Here, the above-described rotational torque T has already exhibited a relationship of T>W with the aforementioned rotational torque W. Further, when the drive of the aforementioned planetary one-way unit 133 is switched, with respect to an idling torque V generating when the planetary gear 142 moves, there is a need to provide a relationship of T>W+V.

Because, in the case of T<W+V, a gear interval between the swingable gear 135 and the pressing roller gear 111 increases when the idling torque V occurs. After the gears are separated, urging pressure by the slider gear 162 becomes large by a decrease in idling torque V or by movement of the gear interval in an increasing direction, so that the relationship of T>W+V is established. Then, a shaft interval between the swingable gear 135 and the pressing roller gear 111 is shortened and these gears contact each other, so that contact noise occurs.

In order to prevent occurrence of the noise, the swingable unit 43 is pressed so that T>W+V always holds in a state in which the swingable gear 135 and the pressing roller gear 111 are engaged with each other, and thus the swingable gear 135 and the pressing roller gear 111 are prevented by the idling torque V from being separated from each other.

In this embodiment,

Torque T by pressing pressure of slider spring 162=4 N.cm,

Rotational torque W by self-weight of swingable unit=0.45 N.cm,

Idling torque V of planetary one-way unit 133=2 N.cm, are set, so that T>W+V holds.

In the above description, it is better that a value of T is made larger, but the torque T presses the slider 161 during a closing operation of the openable door 26. When the torque is made large, an operating force necessary when the openable door 26 is closed becomes large, and therefore, is not preferred, so that set values in this embodiment are used.

As described above, in the drive switching device 130 for switching the drive of the pressing roller 106 and the drive of the pressing releasing mechanism 41 by the normal and reverse rotation of the motor, when the jam clearance is performed, drive transmission between the pressing roller gear 111 and the swingable gear 135 is shut off by opening the openable door 26. For that reason, transmission of the drive to the pressing releasing mechanism 42 by the rotation of the pressing roller 106 during the jam clearance is prevented.

Further, even when the idling torque V generates during the drive switching, setting is made so that T>W+V holds between the torque T for pressing the slider spring 163 by the slider 162 and the self-weight torque W by the swingable unit 43. For that reason, between the swingable gear 135 and the pressing roller gear 111, noise due to collision does not occur.

Embodiment 2

A second Embodiment will be described using an operational view of the drive switching device 130 of FIG. 12. In this embodiment 2, switching of drive is carried out using two swingable pendulum gears without using the planetary one-way unit 133 of the Embodiment 1. Other constitutions and actions are similar to the Embodiment 1. For that reason, a portion different from the Embodiment 1 will be principally described.

Figure 12:
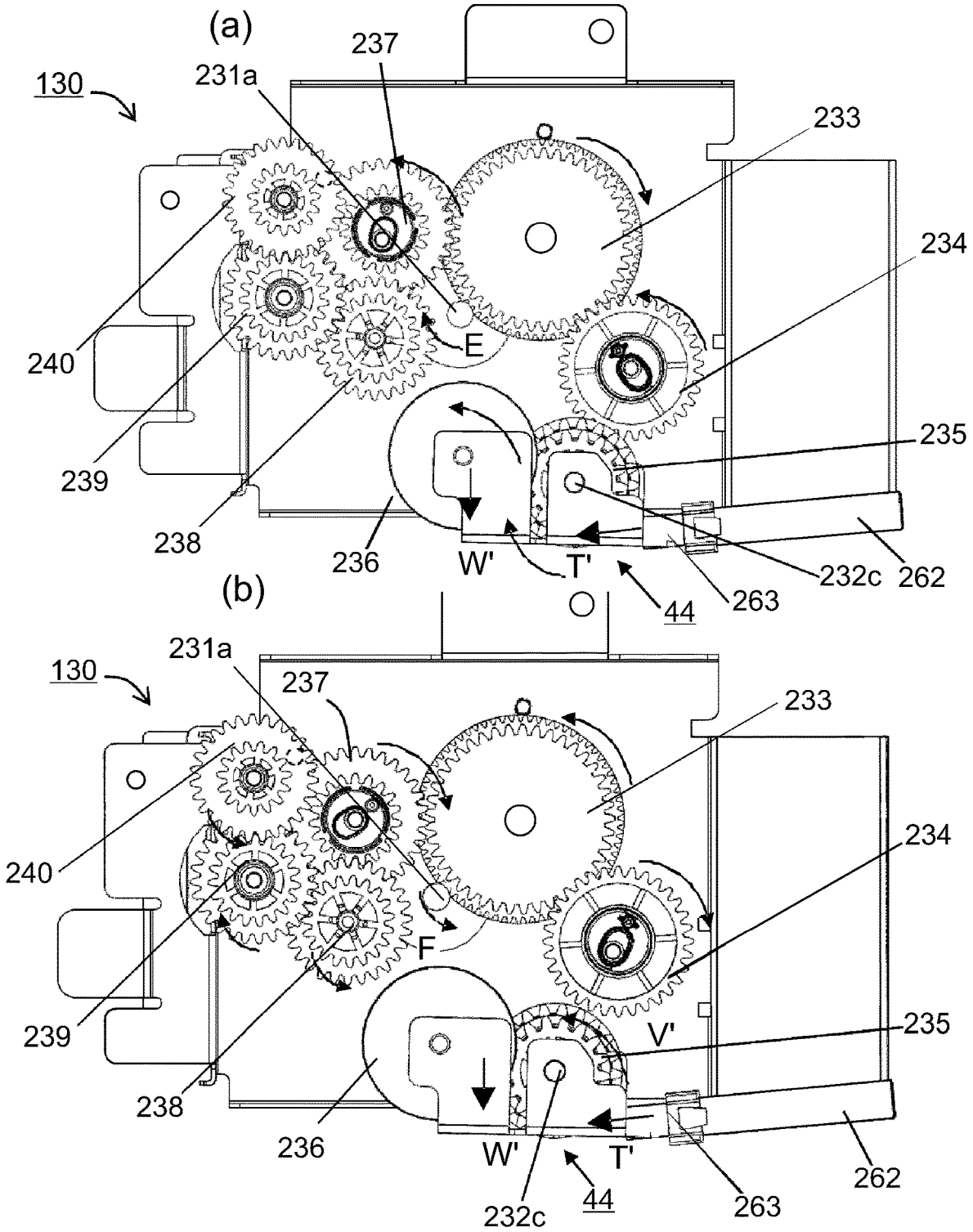
FIG. 12 includes operational views of the drive switching device.

When a motor gear 231*a* rotates in an arrow E direction as shown in part (a) of FIG. 12, the motor gear 231*a* rotates a spring pendulum gear 233, and rotates swingable pendulum gears 234 and 237. In this case, the swingable pendulum gear 237 is disconnected from drive transmission to an idler gear 238. On the other hand, the drive is transmitted from the swingable pendulum gear 234 to a swingable center gear 235, so that the pressing roller 106 can be rotated.

Further, when a motor gear 231*a* rotates in an arrow F direction as shown in part (b) of FIG. 12, the motor gear 231*a* rotates the spring pendulum gear 233, and rotates the swingable pendulum gears 234 and 237. In this case, the swingable pendulum gear 234 is disconnected from drive transmission to the swingable center gear 235. On the other hand, the drive is transmitted from the swingable pendulum gear 237 to the idler gear 238, so that the pressing releasing mechanism 42 can be rotated.

Also at this time, by urging the swingable unit 44, in a relationship among:

Rotation torque V about shaft 232*c*,

Rotation torque W' by self-weight of aforementioned swingable unit 44, and

Idling torque V generating when swingable pendulum gear 234 is moved during switching of drive of swingable pendulum gear 234, Setting is made so that T'>W'+V' holds.

In this Embodiment 2,

Rotation torque W' by self-weight of swingable U44=0.45 N.cm,

Idling torque V of swingable pendulum gear 234=2.5 N.cm, and

Torque T' by pressing pressure of slider spring 263=4.5 N.cm, are set, so that a relationship of T'>W'+V' holds. For this reason, an effect similar to the Embodiment 1 can be obtained.

In FIGS. 12, 239 and 240 are idler gears similar to the idler gears 139 and 140 in FIG. 1. Further, 236 is a swingable gear similar to the swingable gear 135 of the swingable unit 43 in FIG. 1. Further, 262 and 263 are a slider and a slider spring similar to the slider 162 and the slider spring 163 in FIG. 1.

Other Embodiments (1) It is clear that the present invention is not limited to the embodiments described above, but the embodiments can be appropriately changed in addition to those suggested in the embodiments within a scope of a technical concept of the present invention. Further, the numbers, positions, shapes and the like of constituent members are not limited to those in the above-described embodiments, but can be changed to the numbers, the positions, the shapes and the like which are suitable for carrying out the present invention.

(2) For example, in the above-described Embodiments 1 and 2, as the one-way structure for switching the drive, the planetary one-way unit 133 and the swingable pendulum gear 234 were shown, but a one-way clutch and the like are similar thereto, and can obtain effects similar to those in the Embodiments 1 and 2.

(3) In the Embodiments 1 and 2, the fixing device 22 for fixing the unfixed toner image on the recording material was described as an example, but in order to improve gloss (glossiness) of the image, the present invention is also similarly applicable to a device for heating and pressing the toner image once fixed or temporarily fixed on the recording material (also in this case, the device is called a fixing device).

(4) A heating means for heating the fixing flange 101 as the rotatable heating member is not limited to the form by the ceramic heater 100 in the embodiments. For example, a heating constitution in which the fixing flange 101 is internally or externally heated using a halogen heater or electromagnetic induction heating coil can also be employed.

(5) The pressing roller 106 as the pressing member can also be changed to the form of a rotatable endless belt member.

(6) The fixing device may also be a pressure fixing device.

(7) The image forming portion of the image forming apparatus is not limited to the image forming portion of the electrophotographic type. Image forming portions of an electrostatic recording type and of a magnetic recording type may also be used. The transfer type is not limited to the transfer type in the Embodiments, but may also be a transfer type with a constitution in which the unfixed toner image is formed on the recording material P by a direct type.

(8) The fixing device 22 is not limited to the fixing device fixed inside the image forming apparatus, but may also be assembled into a unit which is dismountable to an outside of the image forming apparatus and which can be exchanged. In this case, the unit may be a type in which the unit including the controller 30 is dismounted and exchanged and may also be a type in which the unit excluding the controller 30 is dismounted and exchanged. Further, the fixing device may also be used singly dependently of the image forming apparatus.

INDUSTRIAL APPLICABILITY

According to the present invention, the fixing device and the image forming apparatus which are capable of performing connection of the pressing release drive by the pressing roller rotation during the jam clearance.

The invention claimed is:

1. An image forming apparatus comprising:

an image forming portion for forming a toner image on a recording material;

a fixing portion including a pair of rotatable members for fixing a toner image by nipping and feeding a recording material, on which the toner image is formed by said image forming portion, in a nip therebetween;

a cover configured to open and close said fixing portion;

a pressing and pressing releasing mechanism configured to press said pair of rotatable members to each other and to release a press of said pair of rotatable members;

a motor;

a drive transmission mechanism including a drive transmission gear train configured to transmit a driving force of said motor to rotate to one of said rotatable members when said motor rotates in a first direction and configured to transmit the driving force of said motor to said pressing and pressing releasing mechanism when said motor rotates in a second direction opposite to the first direction, wherein said drive transmission gear train forms a drive transmission path through which drive is transmitted from said one of said rotatable members to said pressing and pressing releasing mechanism when said one of said rotatable members is reversely rotated in a state the cover is closed; and a drive shut off mechanism configured to shut off said drive transmission gear train with an opening operation of said cover, wherein said drive transmission gear train includes a movable gear, and said movable gear is movable by the opening operation of said cover without rotation of said motor from a drive connection position where the drive transmission path is connected to a drive shut off position where the drive transmission path is shut off.

2. The image forming apparatus according to claim 1, further comprising a moving mechanism configured to selectively move said movable gear between said drive connection position and said drive shut off position.

3. The image forming apparatus according to claim 1, wherein said drive transmission mechanism includes a one way gear with a one way structure for switching drive of said pressing and pressing releasing mechanism and drive of said one of said rotatable members, and wherein a torque T when said movable gear is moved from said drive shut off position to said drive connection position is larger than a sum of a torque W when said movable gear is moved from said drive connection position to said drive shut off position and an idling torque V when drive is started by said one way gear.

4. The image forming apparatus according to claim 1, further comprising:

an opening which is provided in an apparatus main assembly of said image forming apparatus and which permits access to at least said fixing portion, wherein the cover is movable between a closed position where said opening is closed and an open position where said opening is open; and an interrelating member for moving said movable gear from said drive connection position to said drive shut off position with movement of said cover from said closed position to said open position and for moving said movable gear from said drive shut off position to said drive connection position with movement of said cover from said open position to said closed position.

5. The image forming apparatus according to claim 1, wherein one of said pair of rotatable members is an endless belt having flexibility and the other one is a rotatable driving member.

6. The device according to claim 1, wherein said movable gear is positioned to the drive shut off position when said cover is opened, and moves from the drive shut off position to the drive connection position with closing operation of said cover.

7. The device according to claim 1, wherein said pair of rotatable members contact with each other when said pressing and pressing releasing mechanism releases the press of said pair of rotatable members.

8. An image forming apparatus comprising:

an image forming portion for forming a toner image on a recording material;

a fixing portion including a pair of rotatable members for fixing a toner image by nipping and feeding a recording material, on which the toner image is formed by said image forming portion, in a nip therebetween;

a cover configured to open and close said fixing portion;

a pressing and pressing releasing mechanism configured to press said pair of rotatable members to each other and to release a press of said pair of rotatable members;

a motor;

a drive transmission mechanism configured to transmit a driving force of said motor to rotate to one of said rotatable members when said motor rotates in a first direction and configured to transmit the driving force of said motor to said pressing and pressing releasing mechanism when said motor rotates in a second direction opposite to the first direction, wherein said drive transmission mechanism forms a drive transmission path through which drive is transmitted from said one of said rotatable members to said pressing and pressing releasing mechanism when said one of said rotatable members is reversely rotated in a state the cover is closed; and a drive shut off mechanism configured to shut off said drive transmission mechanism by an opening operation of said cover without rotation of said motor.

9. The image forming apparatus according to claim 8, wherein said drive transmission mechanism includes a drive transmission gear train configured to transmit a driving force of said motor, and wherein a part of gears of said drive transmission gear train is constituted to move with opening operation of said cover due to a self-weight of said part of gears of said drive transmission gear train from a drive connection position where the drive transmission path is connected to a drive shut off position where the drive transmission path is shut off.

10. The device according to claim 8, further comprising an interrelating member for moving a part of gears of said drive transmission gear train from said drive connection position to said drive shut off position with movement of said cover from a closed position to an open position and for moving said part of gears of said drive transmission gear train from said drive shut off position to said drive connection position with movement of said cover from said open position to said closed position.

11. The device according to claim 8, wherein said pair of rotatable members contact with each other when said pressing and pressing releasing mechanism releases the press of said pair of rotatable members.

12. The image forming apparatus according to claim 8, wherein one of said pair of rotatable members is an endless belt having flexibility and the other one is a rotatable driving member.

13. The device according to claim 8, wherein a part of gears of said drive transmission gear train is positioned to the drive shut off position when said cover is opened, and moves from the drive shut off position to the drive connection position with closing operation of said cover.

* * * * *